US008843380B2

(12) United States Patent
Lee et al.

(10) Patent No.: US 8,843,380 B2
(45) Date of Patent: Sep. 23, 2014

(54) METHOD AND APPARATUS FOR ENCODING RESIDUAL SIGNALS AND METHOD AND APPARATUS FOR DECODING RESIDUAL SIGNALS

(75) Inventors: Chul-woo Lee, Suwon-si (KR); Geon-hyoung Lee, Hwanseong-si (KR); Jong-hoon Jeong, Suwon-si (KR); Nam-suk Lee, Suwon-si (KR); Han-gil Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1217 days.

(21) Appl. No.: 12/174,936

(22) Filed: Jul. 17, 2008

(65) Prior Publication Data

US 2009/0198499 A1 Aug. 6, 2009

(30) Foreign Application Priority Data

Jan. 31, 2008 (KR) ..... 10-2008-0010319

(51) Int. Cl.
*G10L 19/00* (2013.01)
*G10L 19/08* (2013.01)
*G10L 19/025* (2013.01)

(52) U.S. Cl.
CPC ..... *G10L 19/08* (2013.01); *G10L 19/025* (2013.01)
USPC ..... 704/501; 704/500; 704/502; 704/503; 704/504

(58) Field of Classification Search
USPC ..... 704/500, 501
See application file for complete search history.

(56) References Cited

U.S. PATENT DOCUMENTS

| | | | | |
|---|---|---|---|---|
| 5,394,473 | A * | 2/1995 | Davidson | 704/200.1 |
| 5,848,391 | A * | 12/1998 | Bosi et al. | 704/200.1 |
| 5,886,276 | A * | 3/1999 | Levine et al. | 84/603 |
| 6,266,644 | B1 * | 7/2001 | Levine | 704/503 |
| 6,424,939 | B1 * | 7/2002 | Herre et al. | 704/219 |
| 6,807,528 | B1 * | 10/2004 | Truman et al. | 704/229 |
| 6,978,236 | B1 * | 12/2005 | Liljeryd et al. | 704/219 |
| 7,020,615 | B2 * | 3/2006 | Vafin et al. | 704/500 |
| 7,269,550 | B2 * | 9/2007 | Tsushima et al. | 704/205 |
| 7,275,031 | B2 * | 9/2007 | Hoerich et al. | 704/230 |

(Continued)

FOREIGN PATENT DOCUMENTS

| | | | |
|---|---|---|---|
| EP | 1310943 | A2 | 5/2003 |
| JP | 2004246038 | A | 9/2004 |
| KR | 1020060124568 | A | 12/2006 |
| WO | 2006/048817 | A1 | 5/2006 |

OTHER PUBLICATIONS

Vafin et al. "Modifying Transients for Efficient Coding of Audio" 2001.*

(Continued)

*Primary Examiner* — Leonard Saint Cyr
(74) *Attorney, Agent, or Firm* — Sughrue Mion, PLLC

(57) ABSTRACT

Encoding and decoding of residual signals are provided. In a method of encoding a residual signal of an audio signal, the residual signal is divided into a plurality of sections having different sizes, based on a change of the residual signal. Then, section division information representing information about the divided sections and section-by-section residual signal information representing characteristics of the sections of the residual signal are acquired. Thereafter, the residual signal is encoded based on the section division information and the section-by-section residual signal information.

32 Claims, 8 Drawing Sheets

(56) References Cited

U.S. PATENT DOCUMENTS

| | | | | |
|---|---|---|---|---|
| 7,353,169 | B1 * | 4/2008 | Goodwin et al. | 704/224 |
| 7,460,993 | B2 * | 12/2008 | Chen et al. | 704/230 |
| 7,499,852 | B2 * | 3/2009 | Oomen et al. | 704/206 |
| 7,548,852 | B2 * | 6/2009 | Den Brinker et al. | 704/219 |
| 7,809,580 | B2 * | 10/2010 | Hotho et al. | 704/501 |
| 2003/0115052 | A1 * | 6/2003 | Chen et al. | 704/230 |
| 2004/0181403 | A1 * | 9/2004 | Hsu | 704/230 |
| 2005/0149322 | A1 * | 7/2005 | Bruhn et al. | 704/211 |
| 2005/0177360 | A1 * | 8/2005 | Schuijers et al. | 704/201 |
| 2006/0015328 | A1 * | 1/2006 | Van Schijndel et al. | 704/219 |
| 2006/0031065 | A1 * | 2/2006 | Liljeryd et al. | 704/219 |
| 2006/0031075 | A1 * | 2/2006 | Oh et al. | 704/500 |
| 2006/0136229 | A1 * | 6/2006 | Kjoerling et al. | 704/501 |
| 2006/0161427 | A1 * | 7/2006 | Ojala | 704/219 |
| 2006/0277040 | A1 * | 12/2006 | Sung et al. | 704/219 |
| 2007/0016405 | A1 * | 1/2007 | Mehrotra et al. | 704/203 |
| 2007/0081597 | A1 * | 4/2007 | Disch et al. | 375/242 |
| 2007/0083364 | A1 * | 4/2007 | Wu et al. | 704/230 |
| 2007/0162277 | A1 * | 7/2007 | Kurniawati et al. | 704/200.1 |
| 2007/0248157 | A1 * | 10/2007 | Den Brinker | 375/240 |
| 2008/0027716 | A1 * | 1/2008 | Rajendran et al. | 704/210 |
| 2008/0215317 | A1 * | 9/2008 | Fejzo | 704/217 |
| 2008/0275709 | A1 * | 11/2008 | Den Brinker et al. | 704/500 |
| 2008/0312915 | A1 * | 12/2008 | Den Brinker et al. | 704/219 |
| 2008/0312917 | A1 * | 12/2008 | Ananthapadmanabhan et al. | 704/230 |
| 2009/0006103 | A1 * | 1/2009 | Koishida et al. | 704/500 |
| 2009/0055194 | A1 * | 2/2009 | Hotho et al. | 704/500 |
| 2010/0169081 | A1 * | 7/2010 | Yamanashi et al. | 704/203 |
| 2011/0153336 | A1 * | 6/2011 | Grancharov et al. | 704/500 |

OTHER PUBLICATIONS

Cuperman et al. "A Novel Approach to Excitation Coding in Low-Bit-Rate High-Quality Celp Coders" 2000.* den Brinker et al. "Parametric Coding for High-Quality Audio" 2002.*

Verma et al. "Extending Spectral Modeling Synthesis with Transient Modeling Synthesis" 2002.*

Fuchs et al. "A Scalable CELP/Transform Coder for Low Bit Rate Speech and Audio Coding" May 2006.*

Tsou et al. "On the Improvement of Scalable MPEG-4 CELP at Low Bitrate" 2003.*

Christensen et al. "Efficient Parametric Coding of Transients" Jul. 2006.*

Schuijers et al. "Advances in Parametric Coding for High-Quality Audio" 2003.*

Riera-Palou et al. "A Hybrid Parametric-Waveform Approach to Bit Stream Scalable Audio Coding" 2004.*

Tantibundhit et al. "Speech Enhancement using Transient Speech Components" 2006.*

Ferreira. "Perceptual coding using sinusoidal modeling in the MDCT domain" 2002.*

Cantzos et al. "Enhanced Multichannel Audio Resynthesis Through Residual Processing and Features Alignment" IEEE International Conference on Multimedia and Expo, Jul. 2007, pp. 1267-1270.

Herre et al. "MPEG Surround—The ISO/MPEG Standard for Efficient and Compatible Multi-Channel Audio Coding." AES 122nd Convention Paper. May 2007, pp. 1-23.

* cited by examiner

METHOD AND APPARATUS FOR ENCODING RESIDUAL SIGNALS AND METHOD AND APPARATUS FOR DECODING RESIDUAL SIGNALS

CROSS-REFERENCE TO RELATED PATENT APPLICATION

This application claims priority from Korean Patent Application No. 10-2008-0010319, filed on Jan. 31, 2008, in the Korean Intellectual Property Office, the disclosure of which is incorporated herein in its entirety by reference.

BACKGROUND OF THE INVENTION

1. Field of the Invention

Methods and apparatuses consistent with the present invention relate to encoding audio signals, and more particularly, to encoding residual signals and decoding residual signals.

2. Description of the Related Art

With recent developments in digital technology, a technique of transforming analog audio signals into digital audio signals and transmitting the digital audio signals is being widely used in wired communications networks including an existing telephone network and mobile communications networks. Analog audio signals are transformed into digital audio signals by sampling. The digital audio signals are encoded and then transmitted. When the digital audio signals are encoded using a suitable encoding method, the transmission efficiency can greatly increase.

In general, when an audio signal is encoded and then decoded, the original audio signal is different from the decoded audio signal. A difference between an audio signal not yet encoded and an audio signal encoded and then decoded is referred to as a residual signal. For example, a linear predictive coding (LPC) model will now be described.

In the LPC model, an audio signal is divided into sections called frames. If N sampling operations are performed in a single frame, each frame has N sample values.

In the LPC model, a current sample value is obtained by summing previous sample values by using appropriate coefficients. The coefficients are the same within a frame. If an N-th sample value within a frame is S(N), S(N) can be expressed as $a_1*s(1)+a_2*s(2)+ \ldots +a_{n-1}s(N-1)+e(N)$, wherein e(N) corresponds to a residual signal.

When the LPC model is used, not only the audio signal but also the residual signal needs to be encoded and transmitted. However, in general, many bits are not allocated during encoding of a residual signal. In particular, a residual signal is divided into frames of the same size regardless of a change in the residual signal and then encoded. This encoding is not bad when the residual signal slightly changes within a frame. However, when the residual signal greatly changes within a frame, the quality of sound greatly degrades.

FIGS. 1A, 1B, and 1C illustrate an example where a residual signal is encoded and decoded according to a related art technique.

FIG. 1A illustrates a residual signal that is not yet encoded. The residual signal is divided into frames of the same size and then encoded. As illustrated in FIG. 1A, the residual signal greatly changes within a transient section 110.

FIG. 1B illustrates an average energy of the residual signal in each frame.

An average energy of a sampled signal is calculated by $$\sum_{n-1}^{N}(s^2(n)), \qquad \text{Equation}$$

and is encoded to serve as a representative value of a corresponding frame.

FIG. 1C illustrates a residual signal that has been encoded and decoded. A decoding unit (not shown) decodes the residual signal by using the average energy values of the residual signal in each frame. Referring to FIG. 1C, almost the original residual signal is restored from a frame of the residual signal that has slightly changed, but the original residual signal is not restored in a transient section 110 where the residual signal has greatly changed. When the residual signal slightly changes within a frame, the original signal can be suitably represented by a single representative value of the frame. However, when the residual signal greatly changes within a frame, as in the transient section 110, it is impossible to accurately represent the original signal by a single representative value of the frame.

As described above, in a conventional encoding method, a residual signal is divided into frames of the same size and then encoded, and thus the residual signal cannot be properly restored from a frame of the residual signal that has greatly changed because a sufficient number of bits are not allocated to the encoding of the residual signal. Therefore, the performance of encoding drastically degrades. In particular, in a transient section where the residual signal greatly changes, the quality of sound is greatly deteriorated as compared with a signal that is not yet encoded.

SUMMARY OF THE INVENTION

The present invention provides a method and apparatus for effectively encoding greatly-changing sections of a residual signal by using a small number of bits, and a method and apparatus for decoding a residual signal encoded according to the encoding method and apparatus.

According to an aspect of the present invention, there is provided a method of encoding a residual signal of an audio signal, comprising the operations of: dividing the residual signal into a plurality of sections having different sizes, based on a change of the residual signal; acquiring section division information representing information about the divided sections and section-by-section residual signal information representing characteristics of the residual signal in each section; and encoding the residual signal based on the section division information and the section-by-section residual signal information.

The operation of dividing the residual signal may include the sub-operations of: dividing the residual signal into a plurality of sections having identical sizes; calculating average energy values of the residual signal in the sections; and re-dividing the equally divided residual signal in such a way that when a difference between an average energy value of the residual signal in a first section and an average energy values of the residual signal in a second section which is adjacent the first section is less than or equal to a predetermined threshold value, the first and second sections are integrated into a single section, or when the difference is greater than the predetermined threshold value, the first and second sections are maintained as separate sections.

The operation of dividing the residual signal into the plurality of sections having different sizes may further include the sub-operations of: detecting a transient section including a transient component among the divided sections; and dividing the transient section into a plurality of sub-sections, wherein the transient component is a component of the residual signal that changes at a speed equal to or greater than a threshold speed.

The operation of detecting the transient section may include the sub-operation of receiving information about a location of the transient section.

The section-by-section residual signal information may include average energy values of the residual signal in each section. The operation of encoding the residual signal may include the sub-operations of: calculating a difference value between an average energy value of the residual signal in a current section which is to be encoded and an average energy value of the residual signal in a previous section which exists before the current section; and encoding the residual signal in the current section based on the difference value.

The operation of calculating the difference value may include the sub-operation of calculating a first difference value representing a difference between the average energy value of the residual signal in the current section and an average energy value of the residual signal in an immediately previous section which exists immediately before the current section.

The current section may be a first sub-section of a first transient section. The operation of calculating the difference value may further include the sub-operation of calculating a second difference value representing a difference between the average energy value of the residual signal in the current section and an average energy value of the residual signal in a first sub-section of a second transient section which exists before the first transient section. In the operation of encoding the residual signal, the residual signal in the current section is encoded based on a difference value which is smaller between the first and second difference values.

The residual signal may represent a difference between an audio signal that is not yet encoded and an audio signal that has been encoded using a linear predictive coding model and then decoded.

According to another aspect of the present invention, there is provided a method of decoding a residual signal corresponding to an encoded audio signal, comprising the operations of: acquiring section division information representing information about sections into which the encoded residual signal has been divided and section-by-section residual signal information representing characteristics of the residual signal in each section, from the encoded residual signal; and restoring the residual signal by using the section division information and the section-by-section residual signal information, wherein the encoded residual signal is obtained by dividing a residual signal into a plurality of sections having different sizes and encoding the residual signal in each section.

The plurality of sections may be divided based on a change of the residual signal.

At least one of the plurality of sections may be a transient section comprising a transient component that changes at a speed equal to or greater than a threshold speed. The transient section may comprise a plurality of subsections.

The section-by-section residual signal information may comprise a difference value between an average energy value of the residual signal in a current section that is to be encoded and an average energy value of the residual signal in a previous section that exists before the current section. The operation of restoring the residual signal may comprise the suboperations of: calculating the average energy value of the residual signal in the current section by using the difference value; and generating a random noise signal corresponding to the current section, having intensity proportional to the average energy value of the residual signal in the current section, based on the section division information and the average energy of the residual signal in the current section.

The previous section may be an immediately previous section that exists right before the current section. The section-by-section residual signal information may comprise a first difference value between the average energy value of the residual signal in the current section and an average energy value of the residual signal in the immediately previous section.

The current section may be a first sub-section of a first transient section. The previous section may be a first sub-section of a second transient section that exists before the first transient section. The section-by-section residual signal information may comprise a second difference value between the average energy value of the residual signal in the current section and an average energy value of the residual signal in the first sub-section of the second transient section.

The residual signal may represent a difference between an audio signal that is not yet encoded and an audio signal that has been encoded using a linear predictive coding model and then decoded.

According to another aspect of the present invention, there is provided an apparatus for encoding a residual signal of an audio signal, comprising: a section division unit which divides the residual signal into a plurality of sections having different sizes, based on a change of the residual signal; an information acquiring unit which acquires section division information representing information about the divided sections and section-by-section residual signal information representing characteristics of the residual signal in each section; and an encoding unit which encodes the residual signal based on the section division information and the section-by-section residual signal information.

According to another aspect of the present invention, there is provided an apparatus for decoding a residual signal corresponding to an encoded audio signal, comprising: an information acquiring unit which acquires section division information representing information about sections into which the encoded residual signal has been divided and section-by-section residual signal information representing characteristics of the residual signal in each section, from the encoded residual signal; and a signal restoration unit which restores the residual signal by using the section division information and the section-by-section residual signal information, wherein the encoded residual signal is obtained by dividing a residual signal into a plurality of sections having different sizes and encoding the residual signal in each section.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF EXEMPLARY EMBODIMENTS OF THE INVENTION

The present invention will now be described more fully with reference to the accompanying drawings, in which exemplary embodiments of the invention are shown.

Figure 2:
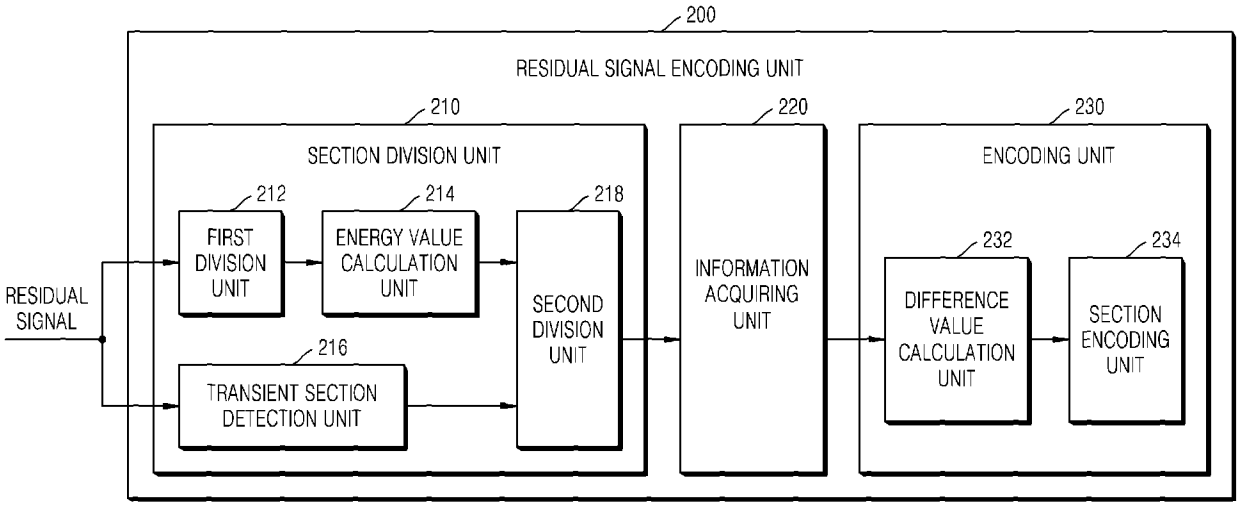
FIG. 2 is a block diagram of a residual signal encoding apparatus according to an exemplary embodiment of the present invention.

FIG. 2 is a block diagram of a residual signal encoding apparatus 200 according to an embodiment of the present invention.

Referring to FIG. 2, the residual signal encoding apparatus 200 according to the current embodiment encodes a residual signal corresponding to an audio signal, and includes a section division unit 210, an information acquiring unit 220, and an encoding unit 230. Throughout the specification, a residual signal represents a difference between an audio signal not yet encoded and an audio signal encoded and then decoded, and an audio signal may be encoded by, for example, a linear predictive coding (LPC) model.

The section division unit 210 divides the residual signal into a plurality of sections having different sizes based on a change in the residual signal. For example, a greatly-changing part of the residual signal becomes a small-sized section, and a slightly-changing part of the residual signal becomes a large-sized section.

The section division unit 210 may include a first division unit 212, an energy value calculation unit 214, a transient section detection unit 216, and a second division unit 218.

The first division unit 212 divides the residual signal into a plurality of sections having identical sizes. The size of each of the sections may be the same as the size of a frame pre-set according to the type of encoding model, more preferably, as the size of each of sub-frames into which the frame is divided.

The energy value calculation unit 214 calculates an average energy of the residual signal in each of the sections. The average energy value of the residual signal in each section may be calculated using sample values included in the corresponding section. When N sampling operations are performed within a single section, N sample values s(1), s(2), . . . , and s(N) are generated. When an average energy value of the residual signal in a first section is E1, E1 is calculated using the following Equation:

$$E_1 = \sum_{n=1}^{N} (s^2(n))$$

The transient section detection unit 216 detects a transient section, which is a section having a transient component. Throughout the specification, a transient component denotes a component included in a residual signal, which changes fast and thus continues for a short period of time. The transient component is detected according to various methods. For example, when a change speed of a component included in a residual signal is equal to or greater than a threshold speed, the component may be determined to be a transient component. However, as in a parametric encoding model of dividing a signal into a sinusoidal signal, a transient signal, and a noise signal and encoding the divided signals, when a location of a transient section is detected in a previous module, the detected location of the transient section is used as it is. In this case, the transient section detection unit 216 includes a reception unit (not shown), which receives information about the location of the transient section in order to detect the transient section.

The second division unit 218 re-divides the equally-divided residual signal into a plurality of sections having different sizes, based on the average energy values of the residual signal in each section and the information about the location of the transient section.

An example in which the equally divided residual signal is re-divided into a plurality of sections having different sizes will now be illustrated. A first section and a second section have identical sizes, and the second section is next to the first section.

When a difference between average energy values of the first and second sections of the residual signal is less than or equal to a predetermined threshold value, the first and second sections are integrated into a single section. In other words, when the average energy values of the residual signal in the first section and in the second section are similar to each other, the first and second sections are integrated into a single section, and thus the number of bits used during encoding is reduced.

On the other hand, when the difference between the average energy values of the residual signal in the first section and the residual signal in the second section is greater than the predetermined threshold value, the first and second sections are maintained separately.

In addition to re-dividing the equally-divided residual signal according to the above-described method, the second division unit 218 also divides the detected transient section into a plurality of sub-sections. Since the residual signal in the transient section has a big change, the division of the transient section into sub-sections may contribute to an accurate restoration of the residual signal.

The information acquiring unit 220 acquires section division information that represents information about the sections of different sizes obtained by the second division unit 218. In other words, the section division information is information about how the residual signal has been divided, and may include information about the locations of the sections or information about the sizes of the sections.

The information acquiring unit 220 also acquires section-by-section residual signal information representing the characteristics of the residual signal in each section. The section-by-section residual signal information may be any information as long as it represents the characteristics of the residual signal in each section. When it is impossible to allocate enough bits during encoding of the residual signal, a representative value may be determined for each section so as to be used as the section-by-section residual signal information. For example, the average energy values of the residual signal in each of the sections may be used as the section-by-section residual signal information.

The encoding unit 230 encodes the residual signal based on the section division information and the section-by-section residual signal information. The encoding unit 230 may encode the residual signal in the sections, and may include a difference value calculation unit 232 and a section encoding unit 234.

The difference value calculation unit 232 calculates a difference value between an average energy value of the residual signal in a current section and that of the residual signal in a previous section. Throughout the specification, a current section denotes a section which is currently to be encoded, and a previous section denotes a section which has been encoded before the current section. The difference value calculation unit 232 compares, with the current section, at least one of an immediately previous section existing immediately prior to the current section and a first sub-section of a transient section existing before the current section. The transient section includes a plurality of sub-sections, and the first sub-section thereof denotes a sub-section existing first among the sub-sections.

The section encoding unit 234 encodes the residual signal in the current section, based on the difference value and the section division information.

More specifically, when the current section is not a first sub-section of a transient section, the difference value calculation unit 232 only calculates a first difference value between the average energy values of the residual signal in the current section and the residual signal in the immediately previous section of the current section. In this case, the section encoding unit 234 encodes the residual signal in the current section, based on the first difference value and the section division information.

On the other hand, when the current section is the first sub-section of the transient section, encoding the residual signal in the current section based on the first difference value may be improper, because the average energy of the residual signal in the first sub-section of the transient section is greatly different from the average energy of the residual signal in the immediately previous section due to the fact that the transient section drastically changes.

Accordingly, when the current section is the first sub-section of the transient section, the difference value calculation unit 232 also calculates a second difference value in addition to the first difference value. The transient section to which the current section belongs as the first sub-section is referred to as a first transient section. The second difference value represents a difference between the average energy value of the residual signal in the current section and an average energy value of the residual signal in a first sub-section of a second transient section. The second transient section denotes a transient section existing before the first transient section. The section encoding unit 234 compares the first and second difference values and encodes the residual signal in the current section by including a smaller difference value among the first and second difference values, the section division information, and additional information. The additional information may include any information as long as it is associated with encoding of the residual signal, such as, information about which of the first and second difference values has been used to encode the current section.

The section encoding unit 234 may include a quantization unit (not shown) and a packing unit (not shown). The quantization unit (not shown) quantizes a difference value which is used to encode the residual signal in the current section of the residual signal. The packing unit (not shown) packs a result of the quantization, the section division information, and the additional information so as to generate a bitstream. The generated bitstream may be transmitted to a decoding unit.

FIGS. 3A through 3D illustrate an example where a residual signal is encoded and decoded according to an embodiment of the present invention.

Figure 3A:
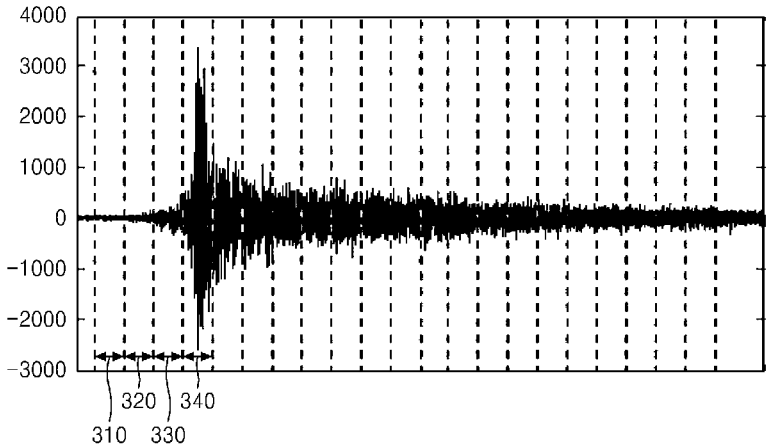
FIGS. 3A through 3D illustrate an example where a residual signal is encoded and decoded according to an exemplary embodiment of the present invention.

FIG. 3A illustrates a division of the residual signal into sections having identical sizes by the first division unit 212.

The size of an average energy of the residual signal in a first section 310 is similar to that in a second section 320 thereof, and the size of the average energy of the residual signal in the second section 320 is different from that in a third section 330. The residual signal in a fourth section 340 drastically changes, and includes a transient component which continues shortly. Accordingly, the fourth section 340 corresponds to a transient section.

Figure 3B:
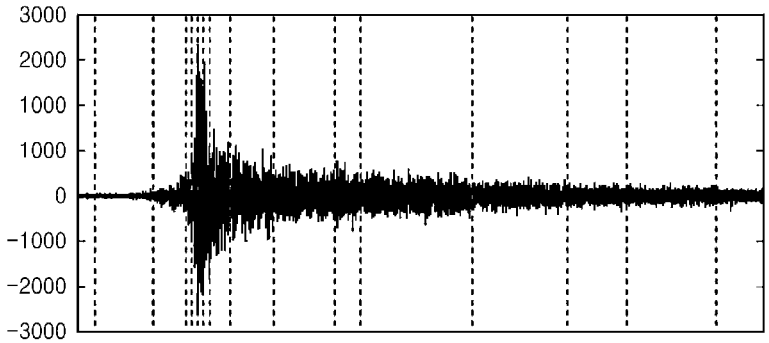

FIG. 3B illustrates a division of the residual signal into sections having different sizes by the second division unit 218.

Referring to FIG. 3B, since the residual signal drastically changes within a transient section, the second division unit 218 divides the fourth section 340 into a plurality of sub-sections. Since the residual signal in the first and second sections 310 and 320 have similar average energy values, the first and second sections are integrated into a single section. On the other hand, the residual signals in the second and third sections 320 and 330 have greatly different average energy values, the second and third sections are maintained separately.

Figure 3C:
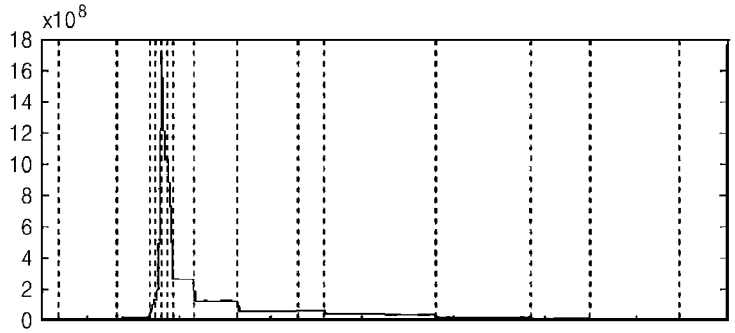

FIG. 3C illustrates an example of the section-by-section residual signal information obtained by the information acquiring unit 220. The section-by-section residual signal information illustrated in FIG. 3C correspond to average energies of the residual signal in the sections. In the residual signal encoding apparatus 200 according to the current embodiment, a transient section is divided into a plurality of sub-sections, and thus changes of the residual signal in the transient section can be more accurately represented.

Figure 3D:
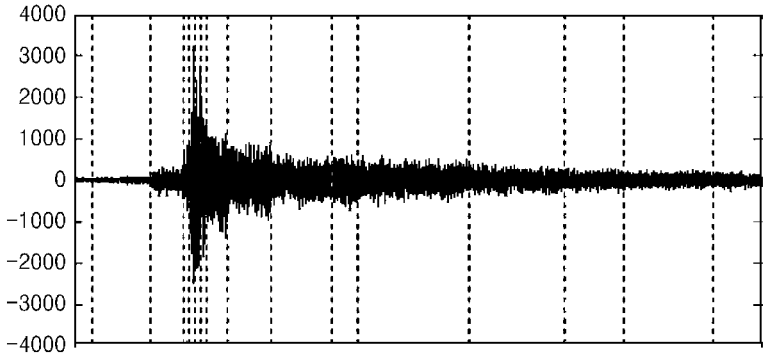

FIG. 3D illustrates a result of decoding of a residual signal that has been encoded by the residual signal encoding apparatus 200.

A residual signal decoding apparatus 600 according to an embodiment of the present invention, which will be described later with reference to FIG. 6, restores a residual signal based on the average energies of the residual signal in the sections. The residual signal decoding apparatus 600 restores the residual signal by generating random noise signals corresponding to the sections. The intensities of the random noise signals are proportional to the average energies of the sections. For example, when a section having an average energy of 40 is decoded, the residual signal decoding apparatus 600 generates a random noise signal having intensity that is twice the intensity of a random noise signal generated when a section having an average energy of 20 is decoded. A detailed description of the residual signal decoding apparatus 600 will be made later with reference to FIG. 6.

Figure 1A:
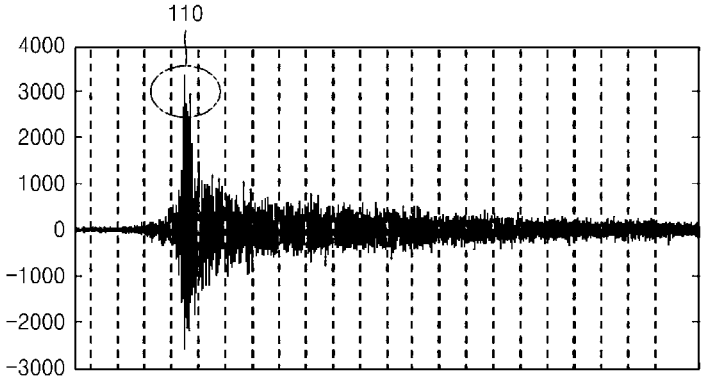
FIG. 1A (RELATED ART)
FIGS. 1A, 1B, and 1C illustrate an example where a residual signal is encoded and decoded according to a related art technique.
Figure 1B:
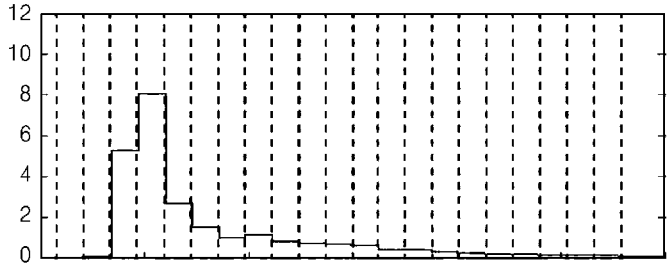
FIG. 1B (RELATED ART)
Figure 1C:
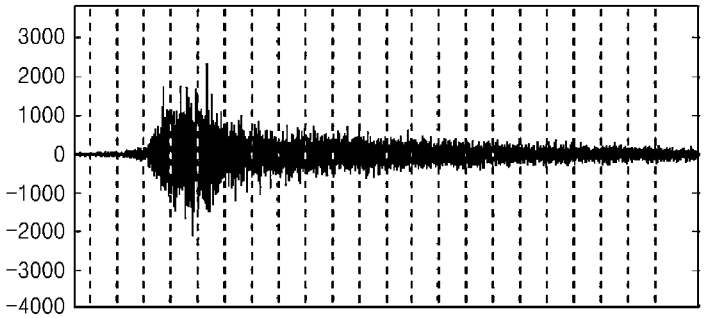
FIG. 1C (RELATED ART)

The residual signal restored by the residual signal decoding apparatus 600 more accurately restores a change of a transient section of the encoded residual signal. In the current embodiment of the present invention, the number of bits used for encoding can be reduced by integrating sections having similar average energy values into a single section. The more accurate restoration of transient sections is apparent when comparing the residual signal of FIG. 3D with the residual signal of FIG. 1C restored according to a related art.

Figure 4:
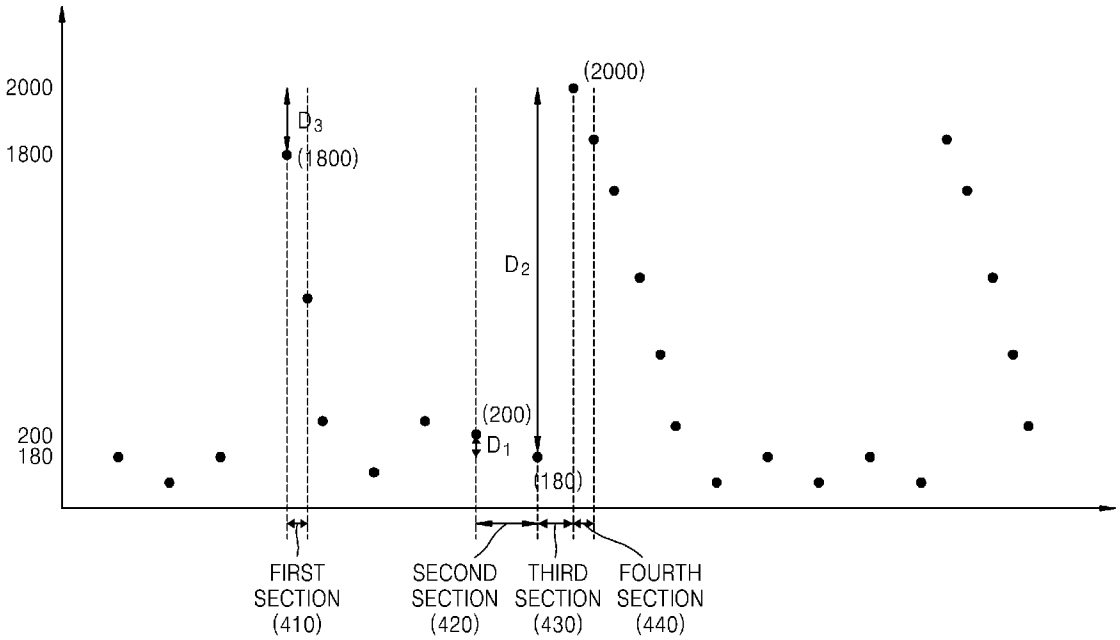
FIG. 4 illustrates an operation of a difference value calculation unit according to an exemplary embodiment of the present invention.

FIG. 4 illustrates an operation of the difference value calculation unit 232, according to an embodiment of the present invention.

Referring to FIG. 4, the residual signal is divided into sections of different sizes, and average energy values of the residual signal in each section are indicated by dots. A first section 410 and a fourth section 440 are first sub-sections of transient sections, and a second section 420 and a third section 430 are general sections other than transient sections. Encoding of the third and fourth sections 430 and 440 will now be described.

An average energy value of the residual signal in the third section 430 is '180', and an average energy value of the residual signal in the second section 420 is '200'. Accordingly, a difference D1 between the average energy values of the residual signal in the second section 420 and that in the third section 430 is '−20'. The section encoding unit 234 encodes the third section 430 of the residual signal by using the difference D1.

Similarly, since an average energy value of the residual signal in the fourth section 440 of the residual signal is '2000', a difference D2 between the average energy values of 'the residual signal in the third section 430 and that in the fourth section 440 is '+1820'. Since an average energy value of the residual signal in the first section 410 is '1800', a difference D3 between the average energy values of the residual signal in the first section 410 and that in the fourth section 440 is '+200'.

Since the fourth section 440 is a first sub-section of a transient section, the average energy value of the residual signal in the fourth section 440 is very much greater than that in the third section 430. If the residual signal in the fourth section 440 is encoded using the difference D2, a large number of bits are needed. Accordingly, the section encoding unit 234 encodes the residual signal in the fourth section 440 by using the difference D3 instead of the difference D2.

Figure 5:
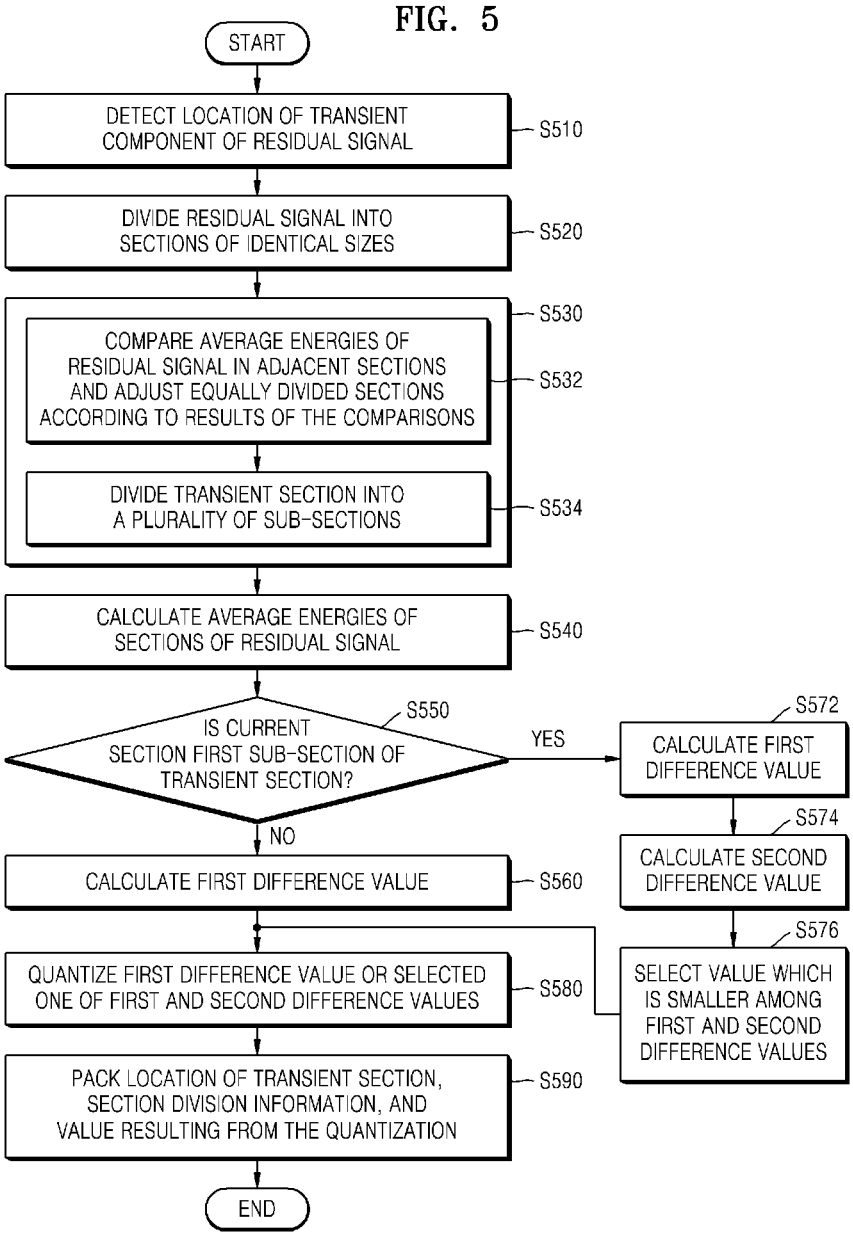
FIG. 5 is a flowchart of a residual signal encoding method according to an exemplary embodiment of the present invention.

FIG. 5 is a flowchart of a residual signal encoding method according to an embodiment of the present invention. Referring to FIG. 5, in operation S510, a location of a transient component of a residual signal is detected. If the location of the transient component is detected in a previous module as when using a parametric encoding model, operation S510 may be omitted.

In operation S520, the residual signal is divided into sections of identical sizes. An audio signal is encoded into sections called frames. Accordingly, in operation S520, the residual signal may be divided into frames. However, in operation S520, the residual signal is divided into subframes smaller than frames in order to more precisely reflect changes of the residual signal. When the residual signal is divided into the sections, average energies of the residual signal in the sections are calculated.

In operation S530, the equally divided residual signal is re-divided into sections of different sizes based on results of operations S510 and S520. Operation S530 may include operations S532 and S534.

In operation S532, the average energies of the residual signal in the adjacent sections calculated in operation S520 are compared with each other, and the equally divided sections are re-arranged according to results of the comparisons. For example, when a difference between the average energies of the residual signal in the adjacent first and second sections of the residual signal is less than a threshold value, the first and second sections are integrated into a single section. On the other hand, when the difference between the average energies of the residual signal in the adjacent first and second sections of the residual signal is greater than the threshold value, the first and second sections are maintained as separate sections.

In operation S534, a transient section found from the divided sections by referring to information about the location of the transient component detected in operation S510 is divided into a plurality of sub-sections. The order of operations S532 and S534 may be changed according to embodiments.

In operation S540, average energies of the residual signal in the sections re-divided in operation S530 are calculated.

In operation S550, it is determined whether a current section that is to be encoded is a first sub-section of the transient section. If the current section is not the first sub-section of the transient section, operation S560 is performed. If the current section is the first sub-section of the transient section, operations S572 through S576 are performed.

In operation S560, a first difference value representing a difference between an average energy value of the residual signal in the current section and that in an immediately previous section is calculated.

In operation S572, the first difference value is calculated as in operation S560.

In operation S574, a second difference value representing a difference between the average energy value of the residual signal in the current section and that in a first sub-section existing prior to the transient section to which the current section belongs is calculated.

In operation S576, a value which is smaller among the first and second difference values is selected.

In operation S580, the first difference value calculated in operation S570 or the first or second difference value selected in operation S576 is quantized.

In operation S590, a location of the transient section, section division information, and a value resulting from the quantization are packed. However, if the location of the transient section is transmitted to the residual signal decoding apparatus 600 in the previous module, the location of the transient section may not be packed.

Figure 6:
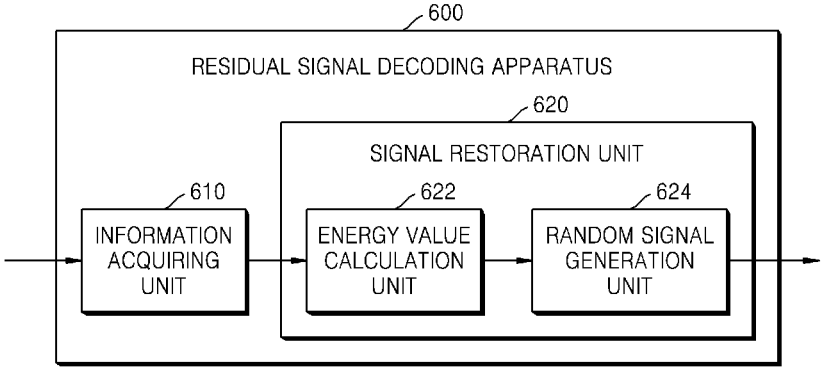
FIG. 6 is a block diagram of a residual signal decoding apparatus according to an exemplary embodiment of the present invention.

FIG. 6 is a block diagram of the residual signal decoding apparatus 600 according to an embodiment of the present invention. Referring to FIG. 6, the residual signal decoding apparatus 600 includes an information acquiring unit 610 and a signal restoration unit 620.

The information acquiring unit 610 acquires section division information and section-by-section residual signal information from a residual signal of an audio signal, which has been divided into a plurality of sections having different sizes and encoded. The section division information represents information about the divided sections, and the section-by-section residual signal information represents characteristics of the residual signal in the sections.

The encoded residual signal may be a bitstream in which several pieces of information are packed. The information acquiring unit 610 acquires the section division information and the section-by-section residual signal information by unpacking the bitstream and classifying the pieces of information unpacked from the bitstream.

The section division information includes information about how the residual signal has been divided. For example, the section division information may include location information such as the locations and sizes of the sections. The residual signal has been divided based on a change in the residual signal during encoding. At least one of the divided sections may be a transient section. The transient section includes a transient component. In the transient section, the residual signal drastically changes.

The section-by-section residual signal information represents characteristics of the residual signal in the sections. The section-by-section residual signal information may be any information as long as it can restore the residual signal in each section. For example, the section-by-section residual signal information may be an average energy value of the residual signal in a current section or a first difference value representing a difference between the average energy value of the residual signal in the current section and that in an immediately previous section. Alternatively, the section-by-section residual signal information may be a second difference value representing a difference between the average energy value of the residual signal in the current section and that in a first sub-section of a transient section existing prior to the current section. The second difference value may be used when the average energy value of the residual signal in the current sections are greatly different from that in the immediately previous section thereof, as when the current section is a first sub-section of a transient section.

The signal restoration unit 620 restores the residual signal based on the section division information and the section-by-section residual signal information. The signal restoration unit 620 may include a random signal generation unit 624. Alternatively, the signal restoration unit 620 may include an energy value calculation unit 622 and the random signal generation unit 624. The random signal generation unit 624 generates random noise signals corresponding to the sections based on the section division information and average energy values of the residual signal in each section, thereby restoring the residual signal. The random noise signals have intensities that are proportional to the average energy values of the residual signal in the sections.

The signal restoration unit 620 further includes the energy value calculation unit 622 which calculates an average energy value of a current section of the residual signal from the section-by-section residual signal information. The section-by-section residual signal information may be a difference value between the average energy value of the residual signal in the current section and that in a previous section existing before the current section. In this case, the energy value calculation unit 622 calculates the average energy value of the residual signal in the current section by adding the difference value to the average energy value of the residual signal in the previous section.

More specifically, when the section-by-section residual signal information is a first difference value, the energy value calculation unit 622 calculates the average energy value of the residual signal in the current section by adding the first difference value to an average energy value of the residual signal in an immediately previous section existing immediately before the current section. Since the residual signal in the immediately previous section has already been decoded, the average energy value of the residual signal in the immediately previous section has been calculated. On the other hand, when the section-by-section residual signal information is a second difference value, the energy value calculation unit 622 calculates the average energy value of the residual signal in the current section by adding the second difference value to an average energy value of the residual signal in an initial sub-section of a transient section existing before the current section. The location of the first sub-section of the transient section existing before the current section may be obtained from the section division information.

Figure 7:
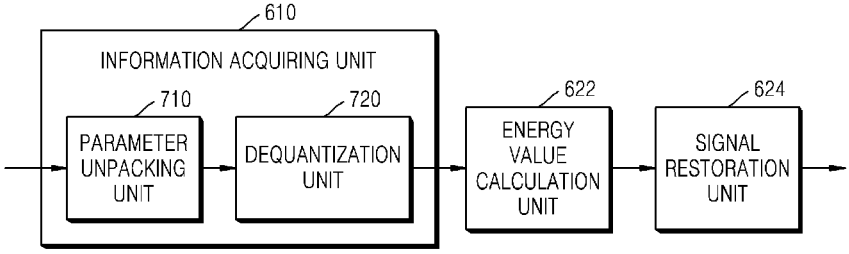
FIG. 7 is a block diagram illustrating a structure of an information acquiring unit illustrated in FIG. 6.

FIG. 7 is a block diagram illustrating a structure of the information acquiring unit 610 illustrated in FIG. 6. Referring to FIG. 7, the information acquiring unit 610 includes a parameter unpacking unit 710 and a dequantization unit 720.

The parameter unpacking unit 710 receives an encoded audio signal. The encoded audio signal is received in the form of a bitstream that includes a core parameter for restoring a core signal and a residual parameter for restoring a residual signal. The parameter unpacking unit 710 extracts the core parameter and the residual parameter from the received bitstream. The residual parameter is assumed as a first difference value between the average energy value of the residual signal in the current section and that in the immediately previous section.

The dequantization unit 720 dequantizes the first difference value.

The energy value calculation unit 622 calculates the average energy value of the current section by adding the dequantized first difference value to the average energy value of the immediately previous section.

The average energy value of the residual signal in the current section is transmitted to the random signal generation unit 624. The random signal generation unit 624 generates a random noise signal corresponding to the current section, which has intensity that is proportional to the average energy value of the residual signal in the current section.

Figure 8:
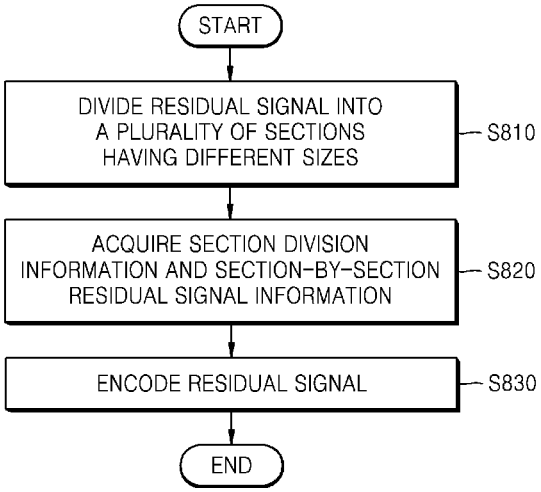
FIG. 8 is a flowchart of a residual signal encoding method according to another exemplary embodiment of the present invention.

FIG. 8 is a flowchart of a residual signal encoding method according to another embodiment of the present invention.

Referring to FIG. 8, in operation S810, a residual signal is divided into a plurality of sections having different sizes based on a change of the residual signal. More specifically, the residual signal is divided into a plurality of sections having identical sizes, and then average energy values of the residual signal in the sections are calculated. The equally divided residual signal is re-divided in such a way that when a difference between an average energy value of the residual signal in a first section and that of the residual signal in a second section existing prior to the first section is less than or equal to a predetermined threshold value, the first and second sections are integrated into a single section, or when the difference between the average energy values of the residual signal in the first and second sections is greater than the predetermined threshold value, the first and second sections are maintained as separate sections.

In operation S810, when transient sections including transient components exist, each of the transient sections is divided into a plurality of subsections. A transient component is included in a residual signal and drastically changes. The transient component can be detected by determining whether the change speed of a component is equal to or greater than a threshold speed.

In operation S820, section division information and section-by-section residual signal information are acquired. The section division information represents information about the divided sections, and the section-by-section residual signal information represents characteristics of the divided sections of the residual signal. The section-by-section residual signal information may include the average energy values of the residual signal in each section.

In operation S830, the residual signal is encoded based on the section division information and the section-by-section residual signal information.

More specifically, a first difference value representing a difference between the average energy value of the residual signal in a current section of the residual signal and an average energy value of the residual signal in an immediately previous section which exists immediately before the current section is calculated. The residual signal in the current section is encoded based on the first difference value and the section division information. For example, a bitstream including a result of quantization performed on the first differential value and the section division information is generated. The bitstream may be transmitted to the residual signal decoding apparatus 600.

If the current section is a first sub-section of a transient section, a second difference value representing a difference between the average energy value of the residual signal in the current section and an average energy value of the residual signal in a first sub-section of another transient section existing before the current section is calculated in addition to the first difference value. When the first difference value is less than the second difference value, a bitstream including the first difference value is generated. When the first difference value is greater than the second difference value, a bitstream including the second difference value is generated.

Figure 9:
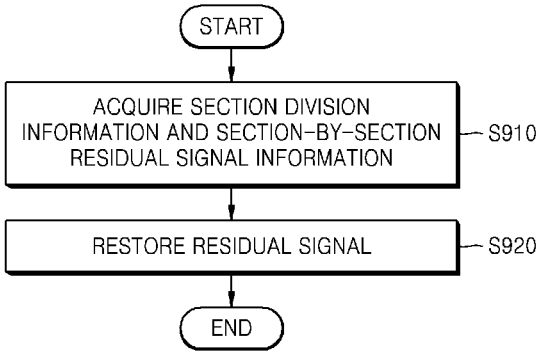
FIG. 9 is a flowchart of a residual signal decoding method according to an exemplary embodiment of the present invention.

FIG. 9 is a flowchart of a residual signal decoding method according to an embodiment of the present invention.

In operation S 910, an encoded residual signal is decoded so as to acquire section division information and section-by-section residual signal information. The encoded residual signal is obtained by dividing a residual signal into a plurality of sections having different sizes and encoding the residual signal in each section. The section division information represents information about the divided sections, and the section-by-section residual signal information represents characteristics of the residual signal in each divided section. The sections may be divided based on changes of the residual signal, and may include transient sections. Each transient section includes a transient component and is divided into a plurality of subsections.

When the section division information and the section-by-section residual signal information are included in a bitstream and received, the bitstream is analyzed in order to acquire the section division information and the section-by-section residual signal information. When the section-by-section residual signal information includes a first difference value, an average energy value of the residual signal in a current section may be obtained by adding the first difference value to an average energy of the residual signal in a previous section existing prior to the current section. On the other hand, when the section-by-section residual signal information includes a second difference value, an average energy value of a current section may be obtained by adding the second difference value to an average energy of the residual signal in a first sub-section of a transient section existing prior to the current section.

In operation S920, the residual signal is restored using the section division information and the section-by-section residual signal information. For example, random noise signals corresponding to the sections, having intensities proportional to the average energies of the residual signal in each section, are generated based on the section division information and the average energies of the sections.

According to the present invention, a transient section of a residual signal is divided into a plurality of subsections and then encoded. Thus, a transient component of the residual signal is more accurately restored, leading to an improvement of the quality of sound.

In addition, sections of the residual signal that have similar average energies are integrated into a single section and then encoded. Thus, the number of bits used during encoding is reduced.

The above-described embodiments of the present invention can be written as computer programs and can be implemented in general-use digital computers that execute the programs using a computer readable recording medium. Examples of the computer readable recording medium include magnetic storage media (e.g., ROM, floppy disks, hard disks, etc.) and optical recording media (e.g., CD-ROMs, or DVDs). The above-described embodiments of the present invention can be written as computer programs and can be implemented in general-use digital computers that execute the programs using a computer readable transmission medium. An example of the computer readable transmission medium is carrier waves (e.g., transmission through the Internet).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of encoding a residual signal of an audio signal, comprising:

dividing the residual signal into a plurality of sections having identical sizes;

calculating average energy values of the residual signal in the plurality of sections having identical sizes; re-dividing the residual signal into a plurality of sections having different sizes, based on the calculated average energy values;

acquiring section division information representing information about the re-divided sections and section-by-section residual signal information representing characteristics of the residual signal in each re-divided section; and encoding the residual signal based on the section division information and the section-by-section residual signal information.

2. The method of claim 1, wherein the re-dividing the equally divided residual signal is that when a difference between an average energy value of the residual signal in a first section and an average energy value of the residual signal in a second section which is adjacent to the first section is less than or equal to a predetermined threshold value, the first and second sections are integrated into a single section, or when the difference is greater than the predetermined threshold value, the first and second sections are maintained as separate sections.

3. The method of claim 2, wherein the re-dividing of the residual signal into the plurality of sections having different sizes further comprises:

detecting a transient section including a transient component among the divided sections; and dividing the transient section into a plurality of sub-sections, wherein the transient component is a component of the residual signal that changes at a speed equal to or greater than a threshold speed.

4. The method of claim 3, wherein the detecting of the transient section comprises receiving information about a location of the transient section.

5. The method of claim 1, wherein:

the section-by-section residual signal information comprises average energy values of the residual signal in each re-divided section; and the encoding of the residual signal comprises:

calculating a difference value between an average energy value of the residual signal in a current section which is to be encoded and an average energy value of the residual signal in a previous section which exists before the current section; and encoding the residual signal in the current section, based on the difference value.

6. The method of claim 5, wherein the calculating of the difference value comprises calculating a first difference value representing a difference between the average energy value of the residual signal in the current section and an average energy value of the residual signal in an immediately previous section which exists immediately before the current section.

7. The method of claim 6, wherein:

the current section is a first sub-section of a first transient section;

the calculating of the difference value further comprises calculating a second difference value representing a difference between the average energy value of the residual signal in the current section and an average energy value of the residual signal in a first sub- section of a second transient section which exists before the first transient section; and in the encoding of the residual signal, the residual signal in the current section is encoded based on a difference value which is smaller between the first and second difference values.

8. The method of claim 1, wherein the residual signal represents a difference between an audio signal that is not yet encoded and an audio signal that has been encoded using a linear predictive coding model and then decoded.

9. A computer readable recording medium having recorded thereon a set of instructions that causes a computer to perform the method of claim 1.

10. A method of decoding a residual signal corresponding to an encoded audio signal, comprising:

acquiring section division information representing information about sections into which the encoded residual signal has been divided and section-by-section residual signal information representing characteristics of the residual signal in each section, from the encoded residual signal; and restoring the residual signal by using the section division information and the section-by-section residual signal information, wherein the encoded residual signal is obtained by re-dividing a residual signal into a plurality of sections having different sizes, based on calculated average energy values of a plurality of sections divided before the re-dividing and having identical sizes, and encoding the residual signal in each re-divided section.

11. The method of claim 10, wherein the plurality of sections having identical sizes are re-divided based on a change of the residual signal.

12. The method of claim 10, wherein:

at least one of the plurality of sections having different sizes is a transient section comprising a transient component that changes at a speed equal to or greater than a threshold speed; and the transient section comprises a plurality of subsections.

13. The method of claim 12, wherein:

the section-by-section residual signal information comprises a difference value between an average energy value of the residual signal in a current section that is to be encoded and an average energy value of the residual signal in a previous section that exists before the current section; and the restoring of the residual signal comprises:

calculating the average energy value of the residual signal in the current section by using the difference value; and generating a random noise signal corresponding to the current section, having intensity proportional to the average energy value of the residual signal in the current section, based on the section division information and the average energy of the residual signal in the current section.

14. The method of claim 13, wherein:

the previous section is an immediately previous section that exists right before the current section; and the section-by-section residual signal information comprises a first difference value between the average energy value of the residual signal in the current section and an average energy value of the residual signal in the immediately previous section.

15. The method of claim 13, wherein:

the current section is a first sub-section of a first transient section;

the previous section is a first sub-section of a second transient section that exists before the first transient section; and the section-by-section residual signal information comprises a second difference value between the average energy value of the residual signal in the current section and an average energy value of the residual signal in the first sub-section of the second transient section.

16. The method of claim 10, wherein the residual signal represents a difference between an audio signal that is not yet encoded and an audio signal that has been encoded using a linear predictive coding model and then decoded.

17. A computer readable recording medium having recorded thereon a set of instructions that causes a computer to perform the method of claim 10.

18. An apparatus for encoding a residual signal of an audio signal, comprising:

a first section division unit which divides the residual signal into a plurality of sections having identical sizes;

an energy value calculation unit which calculates average energy values of the sections having identical sizes;

a second section division unit which re-divides the residual signal into a plurality of sections having different sizes, based on the calculated average energy values of the plurality of sections having identical sizes;

an information acquiring unit which acquires section division information representing information about the re-divided sections and section-by-section residual signal information representing characteristics of the residual signal in each re-divided section; and an encoding unit which encodes the residual signal based on the section division information and the section-by-section residual signal information, wherein at least one of the section division unit, the information acquiring unit, and the encoding unit is implemented as a hardware component.

19. The apparatus of claim 18, wherein the second section division unit re-divides the equally divided residual signal in such a way that when a difference between an average energy value of the residual signal in a first section and an average energy value of the residual signal in a second section which is adjacent to the first section is less than or equal to a predetermined threshold value, the first and second sections are integrated into a single section, or when the difference is greater than the predetermined threshold value, the first and second sections are maintained as separate sections.

20. The apparatus of claim 19, wherein:

the second section division unit further comprises a transient section detection unit which detects a transient section including a transient component among the re-divided sections;

the second section division unit further divides the transient section into a plurality of sub-sections; and the transient component is a component of the residual signal that changes at a speed equal to or greater than a threshold speed.

21. The apparatus of claim 20, wherein the transient section detection unit comprises a reception unit which receives information about a location of the transient section.

22. The apparatus of claim 18, wherein:

the section-by-section residual signal information comprises average energy values of the residual signal in each re-divided section; and the encoding unit comprises:

a difference value calculation unit which calculates a difference value between an average energy value of the residual signal in a current section which is to be encoded and an average energy value of the residual signal in a previous section which exists before the current section; and a section encoding unit which encodes the residual signal in the current section, based on the difference value.

23. The apparatus of claim 22, wherein the difference value calculation unit calculates a first difference value representing a difference between the average energy value of the residual signal in the current section and an average energy value of the residual signal in an immediately previous section which exists immediately before the current section.

24. The apparatus of claim 23, wherein:

the current section is a first sub-section of a first transient section;

the difference value calculation unit further calculates a second difference value representing a difference between the average energy value of the residual signal in the current section and an average energy value of the residual signal in a first sub-section of a second transient section which exists before the first transient section; and the section encoding unit encodes the residual signal in the current section based on a difference value which is smaller between the first and second difference values.

25. The apparatus of claim 18, wherein the residual signal represents a difference between an audio signal that is not yet encoded and an audio signal that has been encoded using a linear predictive coding model and then decoded.

26. An apparatus for decoding a residual signal corresponding to an encoded audio signal, comprising:

an information acquiring unit which acquires section division information representing information about sections into which the encoded residual signal has been divided and section -by-section residual signal information representing characteristics of the residual signal in each section, from the encoded residual signal; and a signal restoration unit which restores the residual signal by using the section division information and the section-by-section residual signal information, wherein the encoded residual signal is obtained by re-dividing a residual signal into a plurality of sections having different sizes, based on calculated average energy values of a plurality of sections divided before the re-dividing and having identical sizes, and encoding the residual signal in each section, and wherein at least one of the information acquiring unit and the signal restoration unit is implemented as a hardware component.

27. The apparatus of claim 26 wherein the plurality of sections having identical sizes are re-divided based on a change of the residual signal.

28. The apparatus of claim 27, wherein:

the section-by-section residual signal information comprises a difference value between an average energy value of the residual signal in a current section that is to be encoded and an average energy value of the residual signal in a previous section that exists before the current section; and the signal restoration unit comprises:

an energy value calculation unit which calculates the average energy value of the residual signal in the current section by using the difference value; and a random noise signal generation unit which generates a random noise signal corresponding to the current section, having intensity proportional to the average energy value of the residual signal in the current section, based on the section division information and the average energy of the current section.

29. The apparatus of claim 28, wherein:

the previous section is an immediately previous section that exists right before the current section; and the section-by-section residual signal information comprises a first difference value between the average energy value of the residual signal in the current section and an average energy value of the residual signal in the immediately previous section.

30. The apparatus of claim 28, wherein:

the current section is a first sub-section of a first transient section;

the previous section is a first sub-section of a second transient section that exists before the first transient section; and the section-by-section residual signal information comprises a second difference value between the average energy value of the residual signal in the current section and an average energy value of the residual signal in the first sub-section of the second transient section.

31. The apparatus of claim 28, wherein the residual signal represents a difference between an audio signal that is not yet encoded and an audio signal that has been encoded using a linear predictive coding model and then decoded.

32. The apparatus of claim 26, wherein:

at least one of the plurality of sections having different sizes is a transient section comprising a transient component that changes at a speed equal to or greater than a threshold speed; and the transient section comprises a plurality of subsections.

* * * * *